United States Patent [19]

Staggs et al.

[11] 4,079,796

[45] Mar. 21, 1978

[54] CUTTING MACHINE AND AUGERING TOOL

[76] Inventors: Arnol Staggs; Margarita C. Flores, both of 1155 Lincoln, Wyandotte, Mich. 48192

[21] Appl. No.: 668,922

[22] Filed: Mar. 22, 1976

[51] Int. Cl.[2] ..... E21B 9/00

[52] U.S. Cl. ..... 175/383; 299/82

[58] Field of Search ..... 175/382, 383, 384, 394, 175/410, 412, 413, 401, 392; 299/91, 93, 94, 82

[56] References Cited

U.S. PATENT DOCUMENTS

| | | | |
|---|---|---|---|
| 558,994 | 4/1896 | Snyder | 175/401 X |
| 2,575,239 | 11/1951 | Stephens | 175/383 |
| 2,930,588 | 3/1960 | Lord | 175/410 X |
| 3,024,856 | 3/1962 | Henning | 175/394 X |
| 3,453,756 | 7/1969 | Schroeder | 175/383 X |
| 3,765,496 | 10/1973 | Flores et al. | 175/383 |
| 3,878,905 | 4/1975 | Schaumann | 175/383 |

*Primary Examiner*—Ernest R. Purser
*Assistant Examiner*—Richard E. Favreau
*Attorney, Agent, or Firm*—Arnold S. Weintraub

[57] ABSTRACT

A machining and augering bit, particularly adapted for earth cutting, has a dual-headed tool holder. Each head receives a work piece which carries a rotatable tool bit. The head includes spaced apart first and second portions, the interior surfaces of which are opposed and which define a work-piece receiving area. A work-piece is received in the area and is utilized to mount to the tool a carbided throw-away cutting bit. With the cutting bit mounted on the work-piece which is seated in the area one of the portions shields a portion of the cutting bit to prevent its exposure to flying debris, as well as the area to be drilled.

9 Claims, 6 Drawing Figures

Fig-1
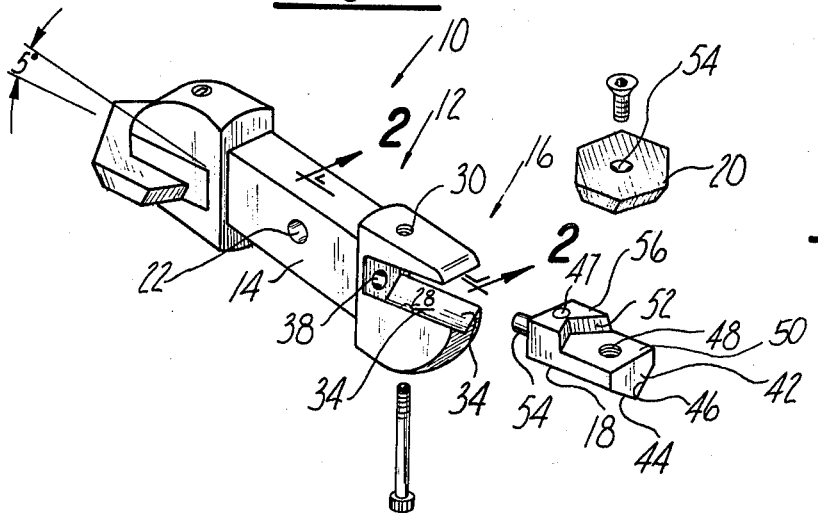
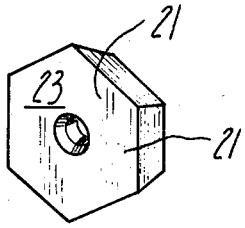
Fig-4
Fig-2
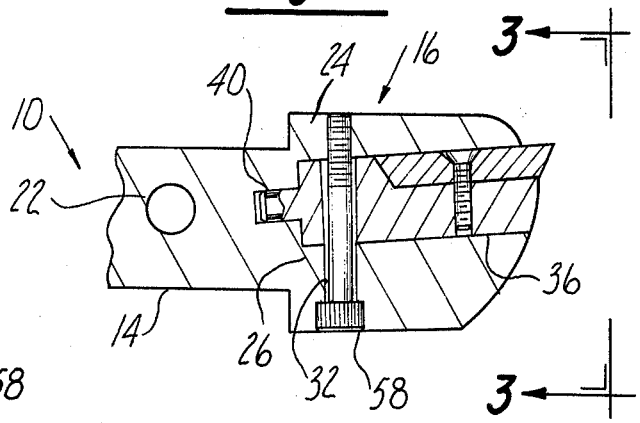
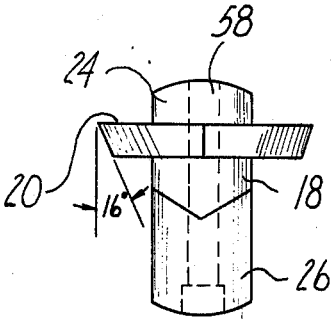
Fig-3

CUTTING MACHINE AND AUGERING TOOL

BACKGROUND OF THE INVENTION

1. Field of the Invention

The present invention pertains to machining and augering. More particularly, the present invention pertains to machining and augering tools. Even more particularly, the present invention pertains to machining and augering tools which are particularly adapted for earth cutting.

2. Prior Art

The earth mining industry, and especially, the coal mining industry has recently undergone a major revival. Mines are presently being re-opened which have laid dormant for many years. With the revival of this industry there has been developed a renewed interest in mining tools. The necessity for mining tools which render mining more efficient is self-apparent.

Heretofore, there has been developed many tools to facilitate drilling, boring and the like. See, inter alia, U.S. Pat. Nos. 2,610,049; 3,203,493; 2,575,239; 2,529,788 and 2,930,588. In our prior Patent U.S. Pat. No. 3,765,496 there is disclosed an improved drill head unit for mining.

The present invention teaches a mode whereby many of the features of our prior drill head can be conveniently and ecomonically incorporated into cutting machine and augering tools for earth cutting. The present invention, while being particularly efficacious in coal mining, can be utilized for salt mining, and the like.

SUMMARY OF THE INVENTION

In accordance with the present invention there is provided a tool for cutting and augering, and which is particularly adapted for earth cutting. The tool hereof comprises a work piece holder having an elongated shank for mounting the holder to an augering or other cutting machine device. The work piece holder receives a work piece which, in turn, carries a rotatable throw-away cutting bit.

In a preferred embodiment of the invention the present tool holder comprises an elongated tool holder having a work piece receiving-head on each end thereof. The holder is configured such that it is reversible with the work piece mounted thereon.

For a more complete understanding of the present invention reference is made to the following detailed description and accompanying drawing. In the drawing, like reference characters refer to like parts throughout the several views, in which:

BRIEF DESCRIPTION OF THE DRAWING

FIG. 1 is an exploded, perspective view of a preferred embodiment of the cutting machine and augering tool of the present invention;

FIG. 2 is a cross-sectional view taken along the line 2—2 of FIG. 1,

FIG. 3 is an end elevational view taken along the line 3—3 of FIG. 2, and

FIG. 4 is a perspective view of the cutting bit utilized in the practice of the present invention.

DESCRIPTION OF THE PREFERRED EMBODIMENTS

Figure 5:
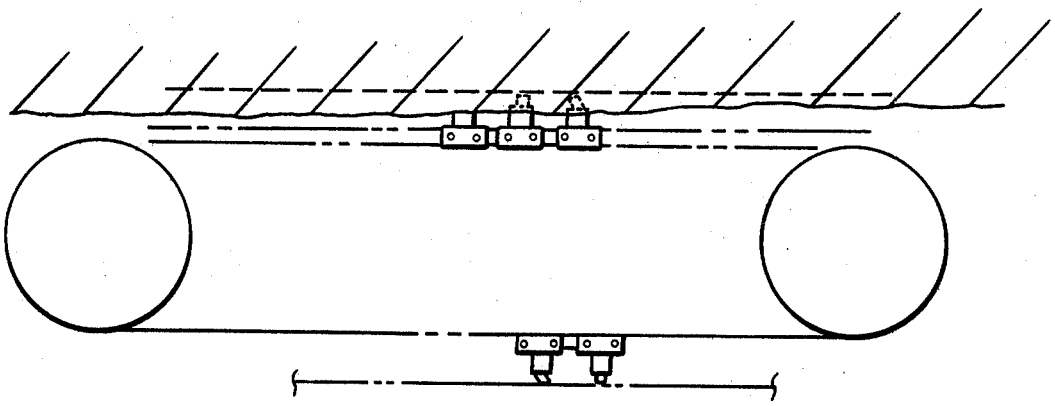
FIG. 5 is a top plan view of a conveyor having a plurality of tool holders hereof mounted to interconnecting links of a chain drive and engaging a wall of a mine to be cut.
Figure 6:
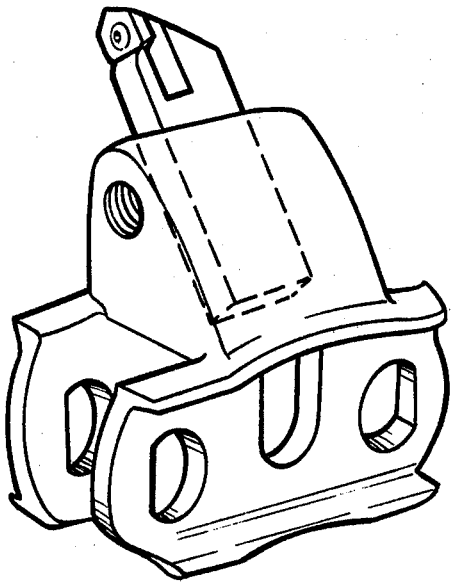
FIG. 6 is a perspective view, partly in phantom, showing the mounting of an earth cutting tool in accordance with the present invention to a single link of the chain shown in FIG. 5.

Now, and with reference to the drawing, there is depicted therein a tool, in accordance with the present invention, and, generally, indicated at 10. The tool 10, generally, comprises an elongated tool holder 12 having a shank portion 14 and a work piece-receiving head 16. The work piece-receiving head 16 receives a work piece 18 which has mounted thereon a cutting bit 20.

With more particularity, the shank 14 comprises an elongated member and includes a central bore or aperture 22. The aperture 22 is used to mount the tool on a machining or augering device (not shown).

The head 16 is integrally formed with the shank 14 at one end thereof. The head 16 comprises a first or forward portion 24 and a rear or second portion 26. Between the two portions is a machined or finished area 28 into which is inserted the work piece-receiving head piece 18. The forward portion 24 of the work piece receiving head is a finished projection having a traversing throughbore 30 formed therethrough. The interior surface of the first portion, which defines the perimeter of the area 28, deviates from the axis of the shank 14 by an angle $\theta$. The angle $\theta$ varies from about 5° to about 10° and is, preferably, about 5°. The second or rear portion 26 is provided with a traversing throughbore 32. The throughbores 30 and 32 are in registry.

The interior surface of the rear portion is provided with converging sidewalls 34. The junction 36 of the sidewalls is parallel to the interior surface of the forward portion 24. The base 38 of the work piece is perpendicular to the plane defined by the interior surface of the forward portion and the junction 36. A partial bore 40 is formed in the base 38 and extends into the shank 14. The bore 40 is substantially perpendicular to the base.

The head 16 is configured to receive the work piece 18. The work piece 18 comprises a main body 42 having a substantially pentagonal configuration including sidewalls 44 and 46. The sidewalls 44 and 46 matingly engage the sidewalls 34 of the rear portion when the work piece is received by the head 16. The work piece 18, also, includes an aperture or bore 47 which aligns with bores 30 and 32, as shown in FIG. 2. Also, the work piece 18 is provided with a partial threaded bore 48 which is provided on the frontal seating surface 50. The bore 48 receives a set screw or the like for fixing the cutting bit thereto. The seating surface is machined out of the work piece, per se. The seating surface includes a V-shaped base 52. The base 52 intersects the surface 50 at angle $\phi$ which deviates from the perpendicular. Generally, the angle $\phi$ ranges from about 15° to about 20° and is, preferably, about 16°. Thus, the V-shaped base diverges outwardly from the surface 50 by an angle ranging from about 105° to about 110°.

The surface and seat 52 cooperate to receive the bit 20, in a manner to be described subsequently.

The work piece, also, comprises a shank 54. The shank 54 seats within and is insertable into the bore 40 which extends into the shank 14. The shank 54 depends from the base of the work piece and is integrally formed therewith.

As noted above, the seating surface 50 receives the cutting bit 20. As shown in FIG. 4, the cutting bit 20 is hexagonal symmetrical member having a central aperture 54. The aperture 54 aligns with the aperture 48, as shown in FIG. 2. The cutting bit 20 is constructed in accordance with the mode defined in U.S. Pat. No. 3,765,469, and comprises a carbided throw-away insert having a plurality of cutting edges 21 and the front surface 23 thereof. The cutting bit 20 is dimensioned to seat against the seating surface such that the plane of its exposed surface is contiguous with the frontal plane surface 56 of the work piece 18. Thus, in forming the cutting bit, it is formed analogously to the base 52. In other words, there is a divergence $x$ from the rear surface of the bit 20 to the front surface 23. The divergence $x$ is equal to the angle $\phi$. In this manner the bit 20 matingly seats in the base 52.

Referring specifically to FIG. 2, there is shown therein the mounting of the work piece and cutting bit, The work piece is inserted into the head 16. Then, the cutting bit 20 is seated on the surface and the base, as shown. A fastener, such as a bolt 58 is inserted through the registering apertures 30, 32 and 47. By virtue of threads 60 formed in the aperture 30, the bolt 58 locks the work piece in position. The set screw locks the cutting bit to the seating surface 50 via the registering aperture 54 and partial bore 48. After one of the cutting edges is worn out, the set screw is loosened and the bit is rotated to expose new carbided cutting surfaces.

Referring to FIG. 1 there is depicted therein a particularly preferred embodiment of the invention. According to this embodiment of the invention the elongated shank 14 carries a pair of opposed work piece receiving heads 16, one on each end of the shank. Each head 16 is constructed in the manner heretofore described. In essence, one head is the "refractive" image of the other, i.e. the equivalent components of each head are diametrically opposed or 180° apart. In this manner the tool hereof is rendered reversible.

It will be appreciated from the preceding that there has been described herein a cutting machine and augering tool of improved efficiency and reduced cost. The tool hereof, as noted before is extremely and particular efficacious in earth cutting processes. The tool hereof can be used in continuous mining, long wall mining, as well as functioning as a cutting machine and auger.

Having, thus, described the invention what is claimed is:

1. An earth cutting and augering tool, comprising:
(a) an elongated shank,
(b) a work-piece receiving head integrally formed with the shank, the work-piece receiving head comprising:
(1) a first portion,
(2) a second portion spaced from the first portion, the first portion having at least one interior surface which is opposed to at least one interior surface of the second portion, the area between the opposed interior surfaces of the portions defining a work-piece receiving area, and wherein the interior surface of one of the portions comprises outwardly directed converging sidewalls,
(c) a work piece mountable on the tool and received in the area, the work-piece having a cutting bit seating surface,
(d) a carbided throw-away cutting bit seatable on the seating surface,
(e) means for interconnecting the head, the work-piece and the cutting bit, and
wherein one of the portions shields a portion of the cutting bit when the cutting bit is seated in the area.

2. The tool of claim 1 wherein:
the portions of the work piece-receiving head each has an aperture formed therethrough, the work piece has an aperture formed therethrough with the apertures of the work piece-receiving head which is in registry, and the means for interconnecting comprises a threaded fastener insertable through the apertures.

3. The tool of claim 1 wherein:
(a) the base of the work piece receiving head is provided with a bore which extends into the elongated shank, and
(b) the work piece further comprises a shank, the shank being insertable into the bore.

4. The tool of claim 1 wherein:
the axis of the work piece receiving head is inclined with respect to the axis of the elongated shank by an angle $\theta$, $\theta$ ranging from about 5° to about 10°.

5. The tool of claim 1 wherein:
The seating surface of the work piece further comprises a V-shaped notched base, the cutting bit seating against the surface and the base.

6. The tool of claim 5 wherein:
the V-shaped notched base diverges outwardly from the seating surface by an angle $\phi$, the angle $\phi$ ranging from about 105° to about 110°.

7. The tool of claim 1 wherein:
(a) the work piece has a pentagonal configuration and
(b) two adjacent sidewalls of the work piece matingly engage the sidewalls of one of the portions.

8. A cutting bit for use with a cutting machine and augering tool comprising:
(a) a symmetrical hexagonal flat member having six cutting sides, the member having a front surface and a rear surface,
(b) the front surface diverging outwardly from the rear surface by an angle ranging from about 15° to 20°,
(c) the front surface having a recess formed therein for seating the head of a fastening means therewithin, and
wherein the cutting bit is a throw-away insertable bit having a completely carbided exterior.

9. An earth cutting and augering tool, comprising:
(a) an elongated shank,
(b) a work piece receiving head integrally formed with the shank, the head comprising:
(1) a first portion, and
(2) a second portion spaced from the first portion, the area between the opposed interior surfaces of the portions receiving a work piece,
(3) the interior surfaces of one of the portions comprising outwardly directed converging sidewalls:
(c) a work piece mountable on the tool and received in the area, the work piece having a cutting bit seating surface, and a pentagonal configuration,
(d) a carbided throw-away cutting bit seatable on the seating surface,
(e) means for interconnecting the head, the work piece and the cutting bit, and
wherein two adjacent sidewalls of the work piece matingly engage the sidewalls of one of the portions.

* * * * *